US010246791B2

(12) United States Patent
Malshe et al.

(10) Patent No.: US 10,246,791 B2
(45) Date of Patent: Apr. 2, 2019

(54) ELECTRODEPOSITION MEDIUMS FOR FORMATION OF PROTECTIVE COATINGS ELECTROCHEMICALLY DEPOSITED ON METAL SUBSTRATES

(71) Applicant: GENERAL CABLE TECHNOLOGIES CORPORATION, Highland Heights, KY (US)

(72) Inventors: Vinod Chintamani Malshe, Mumbai (IN); Sameer Shankar Jadhav, Satara (IN); Vitthal Abaso Sawant, Indianapolis, IN (US); Sathish Kumar Ranganathan, Indianapolis, IN (US); Cody R. Davis, Maineville, OH (US); Srinivas Siripurapu, Carmel, IN (US); Vijay Mhetar, Carmel, IN (US); Ryan M. Andersen, Williamsport, PA (US)

(73) Assignee: General Cable Technologies Corporation, Highland Heights, KY (US)

( * ) Notice: Subject to any disclaimer, the term of this patent is extended or adjusted under 35 U.S.C. 154(b) by 172 days.

(21) Appl. No.: 14/863,104

(22) Filed: Sep. 23, 2015

(65) Prior Publication Data

US 2016/0083862 A1 Mar. 24, 2016

Related U.S. Application Data

(60) Provisional application No. 62/054,223, filed on Sep. 23, 2014.

(51) Int. Cl.

| | |
|---|---|
| ***C25D 9/06*** | (2006.01) |
| ***C25D 11/02*** | (2006.01) |
| ***C25D 11/04*** | (2006.01) |
| ***C25D 11/06*** | (2006.01) |
| ***C25D 11/30*** | (2006.01) |
| ***C25D 11/34*** | (2006.01) |
| ***H01B 1/02*** | (2006.01) |
| *H01B 13/00* | (2006.01) |

(52) U.S. Cl.

CPC ..... *C25D 9/06* (2013.01); *C25D 11/024* (2013.01); *C25D 11/026* (2013.01); *C25D 11/04* (2013.01); *C25D 11/06* (2013.01); *C25D 11/30* (2013.01); *C25D 11/34* (2013.01); *H01B 1/023* (2013.01); *H01B 13/0033* (2013.01)

(58) Field of Classification Search

CPC .. C25D 11/00; C25D 9/06; C25D 9/03; C08B 41/52; C09D 183/04

See application file for complete search history.

(56) References Cited

U.S. PATENT DOCUMENTS

| | | | |
|---|---|---|---|
| 2,231,373 | A | 2/1941 | Schenk |
| 2,578,400 | A | 12/1951 | Cohn |
| 3,524,799 | A | 8/1970 | Dale |
| 3,917,648 | A | 11/1975 | McLeod |
| 4,484,994 | A | 11/1984 | Jacobs, III et al. |
| 4,655,882 | A | 4/1987 | Hiramatsu et al. |
| 5,324,541 | A | 6/1994 | Shuford |
| 5,603,819 | A | 2/1997 | Harris et al. |
| 6,153,080 | A | 11/2000 | Heimann et al. |
| 6,797,147 | B2 | 9/2004 | Dolan |
| 6,821,633 | B2 | 11/2004 | Liu et al. |
| 6,916,414 | B2 | 7/2005 | Dolan |
| 7,015,395 | B2 | 3/2006 | Goldsworthy et al. |
| 7,174,079 | B2 | 2/2007 | Abel et al. |
| 7,438,971 | B2 | 10/2008 | Bryant et al. |
| 7,452,454 | B2 | 11/2008 | Dolan |
| 7,569,132 | B2 | 8/2009 | Dolan |
| 7,578,921 | B2 | 8/2009 | Dolan |
| 7,683,262 | B2 | 3/2010 | Guery et al. |
| 7,752,754 | B2 | 7/2010 | Goldsworthy et al. |
| 7,820,300 | B2 | 10/2010 | Dolan |
| 8,361,630 | B2 | 1/2013 | Dolan |
| 8,371,028 | B2 | 2/2013 | Goldsworthy et al. |
| 8,663,807 | B2 | 3/2014 | Dolan |
| 2002/0100696 | A1 | 8/2002 | Sano et al. |
| 2003/0070935 | A1 | 4/2003 | Dolan |
| 2003/0075453 | A1 | 4/2003 | Dolan |
| 2004/0137239 | A1 | 7/2004 | Klos et al. |
| 2005/0115840 | A1 | 6/2005 | Dolan |
| 2005/0121332 | A1 | 6/2005 | Kochilla et al. |
| 2006/0016690 | A1 | 1/2006 | Ostrovsky |

(Continued)

FOREIGN PATENT DOCUMENTS

| | | | |
|---|---|---|---|
| JP | 11-43799 | A | 2/1999 |
| KR | 100730776 | B1 | 6/2007 |

(Continued)

OTHER PUBLICATIONS

ASTM Standard Test Methods for Mandrel Bend Test of Attached Organic Coatings. Designation D522/D522M-17, taken from the World Wide Web on Jan. 29, 2018.*

Young, Lee W.; International Search Report and Written Opinion of the International Searching Authority issued in International Application No. PCT/US2015/051731; dated Dec. 21, 2015; 7 pages.

Speers, E.A. et al.; Deposition of Silica Films Using Electrochemical Procedures; J. Electrochem. Soc., vol. 145, Issue 6; 1998; pp. 1812-1819.

Veeraraghavan, B. et al.; Development of a Novel Electrochemical Method to Deposit High Corrosion Resistant Silicate Layers on Metal Substrates; Electrochemical and Solid-State Letters, vol. 6 (2); 2003; 7 pages.

(Continued)

*Primary Examiner* — Nathan M Nutter

(74) *Attorney, Agent, or Firm* — Ulmer & Berne LLP

(57) ABSTRACT

Articles including a conductive metal substrate and a protective coating on the metal substrate are provided. The protective coating is electrochemically deposited from an electrodeposition medium including a silicon alkoxide and quaternary ammonium compounds or quaternary phosphonium compounds. Methods of electrochemically depositing such protective coatings are also described herein.

13 Claims, 3 Drawing Sheets

(56) References Cited

U.S. PATENT DOCUMENTS

| | | | | |
|---|---|---|---|---|
| 2006/0204666 | A1* | 9/2006 | Buczek et al. | C03C 1/008 427/421.1 |
| 2007/0148479 | A1 | 6/2007 | Ishikazi et al. | |
| 2008/0086195 | A1 | 4/2008 | Atanasoka et al. | |
| 2008/0093223 | A1 | 4/2008 | Yoshioka et al. | |
| 2008/0210567 | A1 | 9/2008 | Karuppuchamy et al. | |
| 2009/0071837 | A1 | 3/2009 | Fredenberg et al. | |
| 2009/0098373 | A1 | 4/2009 | Dolan | |
| 2010/0000870 | A1 | 1/2010 | Dolan | |
| 2010/0119736 | A1* | 5/2010 | Yan et al. | C01B 39/36 427/595 |
| 2010/0252241 | A1 | 10/2010 | McDermott et al. | |
| 2010/0276288 | A1 | 11/2010 | Hovestad et al. | |
| 2010/0303716 | A1* | 12/2010 | Jin et al. | A61M 37/0092 424/1.11 |
| 2011/0114497 | A1 | 5/2011 | Kim et al. | |
| 2012/0000783 | A1 | 1/2012 | Suda et al. | |
| 2012/0186851 | A1 | 7/2012 | Winterhalter et al. | |
| 2012/0211365 | A1 | 8/2012 | Joung et al. | |
| 2012/0261158 | A1 | 10/2012 | Daniel et al. | |
| 2012/0279866 | A1* | 11/2012 | Fredenberg et al. | B81C 99/0085 205/131 |
| 2013/0015072 | A1 | 1/2013 | Hiratsuka et al. | |
| 2014/0154808 | A1* | 6/2014 | Patel | G01K 3/04 436/1 |

FOREIGN PATENT DOCUMENTS

| | | | |
|---|---|---|---|
| WO | 99/31745 | A1 | 6/1999 |
| WO | 2006136335 | A1 | 12/2006 |
| WO | 2008038293 | A2 | 4/2008 |

OTHER PUBLICATIONS

Putri, S. et al.; Abstract of article entitled Coating Steel with Nanosilica by Pulsed Direct Current Electrophoresis for Corrosion Protection; published in Advanced Materials Research, vol. 896; 2014; 1 page.

Deepa, P.N. et al.; Abstract of article entitled Electrochemically Deposited Sol-Gel Derived Silicate Films as a Viable Alternative in Thin-Film Design; published in Analytical Chemistry, vol. 75 (20); 2003; 5 pages.

Castro, Y. et al.; Corrosion behaviour of silica hybrid coatings produced from basic catalysed particulate sols by dipping and EPD; Surface and Coatings Technology, vol. 191, 2005; pp. 228-235.

Le Hervet, Morgan; Extended European Search Report, including supplementary European search report and European search opinion, issued in European Patent Application No. 158447003; dated Apr. 25, 2018; 10 pages.

* cited by examiner

ELECTRODEPOSITION MEDIUMS FOR FORMATION OF PROTECTIVE COATINGS ELECTROCHEMICALLY DEPOSITED ON METAL SUBSTRATES

REFERENCE TO RELATED APPLICATIONS

The present application claims the priority of U.S. provisional application Ser. No. 62/054,223, entitled ELECTRODEPOSITION MEDIUMS FOR FORMATION OF PROTECTIVE COATINGS ELECTROCHEMICALLY DEPOSITED ON METAL SUBSTRATES, filed Sep. 23, 2014, and hereby incorporates the same application herein by reference in its entirety.

TECHNICAL FIELD

The present disclosure generally relates to protective coatings formed from electrodeposition mediums being electrochemically deposited on metal substrates and methods thereof.

BACKGROUND

Untreated metal substrates can suffer from a variety of undesirable attributes that limit their usage in certain applications. For example, untreated metal substrates can have soft, easily damageable surfaces that are susceptible to oxidation and corrosion damage from the surrounding environment. Although it is known to use anodization processes to provide a protective layer, protective layers formed through an anodization process are relatively thin, fail to provide certain desirable attributes, and can be susceptible to chemical corrosion, heat cracking, and physical inflexibility. Consequently, it would be desirable to provide an electrochemical deposition process to provide metal substrates with effective protective coating layers that provide desirable benefits including, heat stability, physical flexibility, and superior heat transfer properties.

SUMMARY

In accordance with one example, an article includes an electrically conductive metal substrate and a protective coating. The protective coating is electrochemically deposited from an electrodeposition medium. The electrodeposition medium includes a silicon alkoxide, one or more quaternary ammonium compounds or quaternary phosphonium compounds, and water.

In accordance with another example, a method of electrodepositing a protective coating on a conductive surface of a metal is provided. The method includes providing an electrodeposition medium, providing a metal substrate having a conductive surface, providing a cathode, contacting at least a portion of the conductive surface of the metal substrate with the electrodeposition medium, conducting current from the at least a portion of the conductive surface to the cathode, and forming a protective coating on the metal substrate. The electrodeposition medium includes a silicon alkoxide, one or more quaternary ammonium compounds or quaternary phosphonium compounds, and water.

In accordance with yet another example, an article includes an electrically conductive metal substrate and a protective coating. The protective coating is electrochemically deposited from an electrodeposition medium. The electrodeposition medium includes one or more metal carbonate salts, water, and optionally, an additive. The additive includes one or more of a phosphate compound, a fluoride compound, and a conjugate acid thereof.

DETAILED DESCRIPTION

Figure 1:
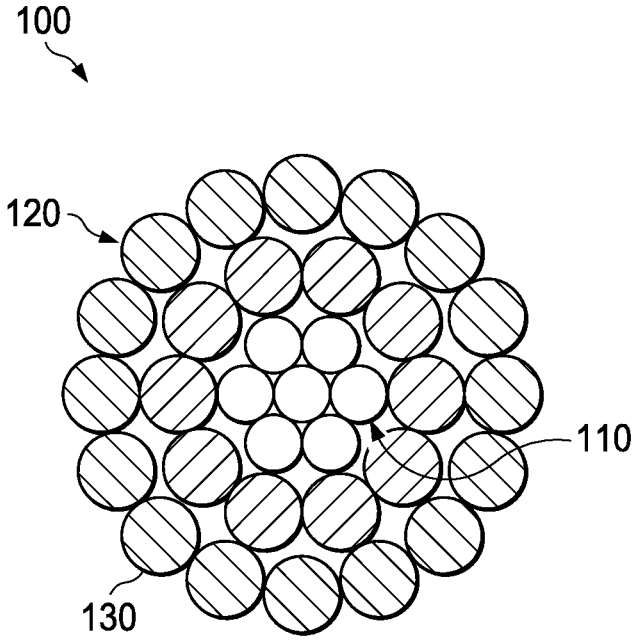
FIG. 1 depicts a cross-sectional view of a conductor in accordance with certain embodiments.

Electrochemical deposition processes can be useful in providing metal substrates with a protective coating. Such protective coatings deposited on metal substrates can impart a number of beneficial properties to the metal substrate including providing, superior heat transfer properties, physical flexibility, as well as resistance to damage and corrosion from a surrounding environment. The protective coating can be deposited onto the metal substrate from the electrodeposition medium. As can be appreciated, such electrodeposition from the medium can be different than anodization processes which form the protective coating from the substrate material. For example, in certain embodiments, about 5% or more of the protective coating can be from the electrodeposition medium. Additionally, the protective coating can be formed of chemical species different than the underlying metal substrate.

An electrochemical deposition process can involve several steps in depositing a protective coating to a metal substrate or other surface. For example, such steps can include providing an electrodeposition medium, exposing at least a portion of a metal substrate to the electrodeposition medium, and conducting current through the metal substrate to electrochemically deposit the protective layer on the metal substrate. As will be appreciated, the order of certain steps can vary or be combined with other steps. For example, in certain embodiments, an electrodeposition medium may be deposited around an existing metal substrate, e.g., an electrically conductive wire.

A variety of suitable electrodeposition mediums can be used in the electrochemical deposition process to form protective coatings that offer the benefits described herein. In one embodiment, an electrodeposition medium can include one or more metal components (e.g., a primary metal or metalloid compound), one or more quaternary ammonium compounds, and water. As can be appreciated, such electrodeposition mediums can be free of organic solvent and can be an aqueous solution. The water utilized can be any suitable water that does not interfere with the other components such as, for example, distilled water, deionized water, or demineralized water.

In certain embodiments, the metal components can be selected from a metal oxide, a metal hydroxide, an organometallic compound, a metal alkoxide compound, metal complexes with ketones or diketones, and combinations thereof. Each metal component can have an element selected from zirconium (Zr), hafnium (Hf), yttrium (Y), zinc (Z), silicon (Si), or any of the lanthanide and actinide series metals. Illustrative examples of suitable metal components can include, zirconium isopropoxide, zirconium butoxide, zirconium ethoxide, zirconium complexes with suitable ligands, and combinations thereof.

In certain embodiments, one or more of the metal components can be a silicon alkoxide having the general formula $Si(OR)_4$, where R is an alkyl group. Such metal components are also known as alkyl orthosilicates. Examples of suitable alkyl orthosilicates can include tetraethyl orthosilicate ("TEOS"), tetramethyl orthosilicate, tetrapropyl orthosilicate, and tetrabutyl orthosilicate. An electrodeposition medium including TEOS can be used to produce a silicon oxide protective coating on a metal substrate such as, for example, a silicon dioxide protective coating. In certain embodiments, the concentration of a silicon alkoxide in an electrodeposition medium can be from about 1 g/L to about 10 g/L.

In certain embodiments, one or more metal components can be inorganic metal complexes of zirconium including, for example, ammonium zirconium carbonate ("AZC"), potassium zirconium carbonate, and sodium zirconium carbonate. In certain embodiments, the concentration of such inorganic metal complex in an electrodeposition medium can be from about 3 g/L to about 13 g/L.

In certain embodiments, one, or more, of the metal components can be acidic metals or acidic metalloid species including, for example, acidic metals such as molybdic acid and boric acid or acidic metalloid species such as vanadium pentoxide. The metal or metalloid in such examples can be selected from molybdenum, vanadium, boron, silicon, phosphorus, tungsten, tantalum, arsenic, germanium, tellurium, polonium, or niobium. In certain embodiments, the concentration of the acidic metal or acidic metalloid species in the electrodeposition medium can be from about 0.5 g/L to about 3.5 g/L.

In certain embodiments, the metal component can be aluminum iso-propoxide and the concentration of the aluminum iso-propoxide in the electrodeposition medium can be from about 2 g/L to about 6 g/L.

In certain embodiments, one or more quaternary ammonium compounds or quaternary phosphonium compounds can be added to an electrodeposition medium including the one or more metal components. Suitable quaternary ammonium compounds can include trimethyl hydroxyethyl ammonium hydroxide ("choline"), tetra-butyl ammonium hydroxide, benzyl triethyl ammonium hydroxide, tetra ethyl ammonium hydroxide, tetra methyl ammonium hydroxide, and benzyl trimethyl ammonium hydroxide. Suitable quaternary phosphonium compounds in certain electrodeposition mediums can include tetra butyl phosphonium hydroxide, benzyl triethyl phosphonium hydroxide, tetra ethyl phosphonium hydroxide, tetra methyl phosphonium hydroxide, benzyl trimethyl phosphonium hydroxide, and trimethyl hydroxyethyl phosphonium hydroxide.

Suitable stoichiometric ratios between the one or more metal components and the one or more quaternary ammonium compounds can vary from a mol ratio of about 1:0.3 to a mol ratio of about 1:3. For example, an electrodeposition medium containing about 1 mol of vanadium pentoxide can include about 4 mol of trimethyl hydroxyethyl ammonium hydroxide. In certain embodiments, the one or more quaternary ammonium compounds have a concentration in the electrodeposition medium from about 0.5 g/L to about 10 g/L; and in certain embodiments, from about 1 g/L to about 5 g/L.

In other certain embodiments, additional electrodeposition mediums can be utilized including electrodeposition mediums that are essentially free of the one or more metal components and the one or more quaternary ammonium compounds or quaternary phosphonium compounds. For example, an electrodeposition medium can include one or more metal salts and can be essentially free of one or more quaternary ammonium compounds or quaternary phosphonium compounds. Suitable metal salts can include metal carbonate salts or metal silicate salts.

Metal carbonate salts can include salts of sodium, potassium, lithium, rubidium, and cesium with a carbonate functional group. Suitable metal carbonate salts can include sodium carbonate, sodium bi-carbonate, potassium carbonate, potassium bicarbonate, lithium carbonate, lithium bicarbonate, rubidium carbonate, rubidium bicarbonate, cesium carbonate, and cesium bicarbonate. In certain embodiments, a metal carbonate salt can be included in an electrodeposition medium at a concentration from about 0.1 g/L to about 10 g/L.

Metal silicate salts can include salts of water soluble monovalent metal cations. Suitable metal silicate salts can include lithium silicate, sodium silicate, sodium metasilicate, potassium silicate, rubidium silicate, and cesium silicate. In certain embodiments, a metal silicate salt can be included in an electrodeposition medium at a concentration of about 4 g/L.

Certain electrodeposition mediums, including, for example, aqueous-based electrodeposition mediums with a quaternary ammonium compound or a quaternary phosphonium compound, can further include additional components. For example, in certain embodiments, a co-reactant modifier, or additive, can be included in an electrodeposition medium to improve the adhesion of the electrochemically deposited protective coating to the metal substrate and prevent chalking of the protective coating. Such a co-reactant modifier, or additive, can be a phosphate or fluoride chemical species, or a conjugate acid thereof, such as phosphoric acid, ammonium phosphate species, sodium phosphate species, ammonium fluoride, ammonium bi-fluoride, or combinations thereof. In certain embodiments, a co-reactant modifier or additive can be included in an electrodeposition medium at a concentration from about 1 g/L to about 2 g/L.

Other components can also, or alternatively, be added to (or dispersed in) an electrodeposition medium including nanofillers/nanopowders and pigments. Suitable nanofillers/nanopowders that are added to an electrodeposition medium can produce a hybrid protective coating during the electrochemical deposition process. Such hybrid coatings can contain the nanoparticles in addition to the original components in the electrochemically deposited protective coating. These hybrid coatings can allow for the formation of a protective coating that has a rougher surface or a protective coating that has improved durability or thickness.

Suitable nanofillers/nanopowders that can be dispersed in an electrodeposition medium can include oxides, borides, nitrides, carbides, sulfides, silicides, nanoclay, nanotalc, nanocalcium carbonate, and other nano-sized fillers. Examples of such oxides can include aluminum oxide, zirconium oxide, cesium oxide, chromium oxide, magnesium oxide, silicon oxide, iron oxide, yttrium oxide, compound oxides, spinels, and combinations thereof. Likewise, suitable examples of borides usable as a nanofiller/nanopowder can include zirconium boride, chromium boride, lanthanum boride, and combinations thereof. Suitable examples of nitrides can include silicon nitride, aluminum nitride, boron nitride, and combinations thereof. Examples of carbides can include boron carbide, silicon carbide, chromium carbide, zirconium carbide, tantalum carbide, vanadium carbide, tungsten carbide, and combinations thereof. Sulfide nanofillers/nanopowders can include molybdenum sulfide, tungsten sulfide, zinc sulfide, cobalt sulfide and combinations thereof. Suitable silicides can include tungsten silicide, and molybdenum silicide. As will be appreciated, combinations of one or more nanofillers/nanopowders can also be used in electrodeposition mediums.

In certain embodiments, suitable pigments useful for inclusion in an electrodeposition medium can include IR pigments, organic pigments, and inorganic pigments. As will be appreciated, pigments can vary in size and can, in certain embodiments, be a nanofiller-sized pigment. Examples of certain suitable pigments are disclosed in U.S. Pat. No. 7,174,079 which is hereby incorporated by reference. IR pigments can improve the thermal conductivity of a protective coating by increasing reflection of incident infrared radiation.

Suitable electrodeposition mediums can generally have a pH greater than 7. For example, an electrodeposition medium can have a pH of about 8 to about 14 in certain embodiments, about 8 to about 11 in certain embodiments, or about 10 to about 11 in certain embodiments.

During the electrochemical deposition process, an electrodeposition medium is substantially maintained as a liquid aqueous solution and placed in contact with a least portion of a metal substrate. The electrodeposition medium can be maintained in a suitable container, such as a bath or tank during this process at temperatures ranging from about 0° C. to about 90° C.

A metal substrate that is at least partially exposed and placed in contact with an electrodeposition medium can have a variety of different configurations, shapes and/or desired applications. For example, suitable metal substrates can have a variety of shapes, such as flat, curved, multi-contoured, wire-shaped, or other desired shapes that can comprise all, or only a portion, of a larger article's surface. As non-limiting, illustrative, examples, the metal substrate can be an electrical component such as an electronic winding, a circuit, a transformer, a motor, a rotor, a printed circuit board, an interconnection wire, or a wire for a winding in a high vacuum apparatus according to certain embodiments. Other illustrative examples of such electrical components can include metal substrates exposed to high temperatures such as components or wires of a turbine. The protective coating formed from the electrodeposition processes can offer electrical insulation, high temperature stability, and flexibility to such metal substrates in certain embodiments. As can be appreciated however, in other certain embodiments, the protective coating can alternatively be electrically semi-conductive or conductive.

According to certain embodiments, any metal substrate that is electrically conductive can be protected with a protective coating. Examples of suitable metal substrates can include substrates formed of one or more of aluminum, copper, steel, and magnesium.

Additionally, a coating can be applied to overhead transmission line accessories. For example, a substation can include a variety of accessories that can benefit from the protectives coatings as described herein including breakers and transformers such as current coupling transformers. Additional examples of transmission line accessories which can also benefit from such a protective coating can include deadends/termination products, splices/joints, suspension and support products, motion control/vibration products (sometimes referred to as dampers), guying products, wildlife protection and deterrent products, conductor and compression fitting repair parts, substation products, clamps, corona rings, connectors, busbars, and any other metallic objects employed on or near a transmission line.

In other certain embodiments, a metal substrate can be an aerospace component such as an engine component. The improved corrosion and wear resistance of the protective coating can, in certain such aerospace examples, replace other primers and pre-treatments for aerospace components and aluminized composites. As will be appreciated, the elimination of primers or pre-treatment can reduce manufacturing time and costs.

In certain embodiments, a metal substrate can include exterior components for building structures such as window frames, door frames, doors, sills, roofing tiles, metal chimneys, and any other metal component found in, or near, the building structures such as fences, swimming pool accessories or the like. Additionally, the metal substrate can be metal components found on decks, outdoor furniture, or lawn and gardening equipment. The protective coating in such examples can provide superior corrosion resistance and durability to the metal substrate. As can be appreciated, such corrosion resistance can be particularly beneficial for real estate near certain environments such as arid deserts, or saline oceans.

A metal substrate can also, in certain embodiments, be components of an automotive engine. As will be appreciated, automotive engines can operate through a wide range of extreme conditions including low-temperature short duration usage as well as extended high-speed, high-temperature usage. An electrochemically deposited protective coating can provide automotive engines and other automotive components with necessary wear resistance, corrosion resistance, and reduced friction to operate through such ranges of extreme conditions. Reduction in friction can also improve efficiency and the lifetime of such parts. Examples of other suitable automotive components can include pistons, intake manifolds, brake components, aluminum structural components, steel structural component, water pumps, cylinder heads, and liners.

In other certain embodiments, a metal substrate can alternatively be a component of kitchen equipment. As non-limiting examples, the metal substrate can be a pot, a pan, or can be a component of kitchen equipment such as stand mixers, blenders, or food processors. Such metal substrates can benefit from the improved durability and heat protection of an electrochemically deposited protective coating.

As will be yet further appreciated, an electrochemically deposited protective coating can also be useful for metal substrates exposed to saline environments found near saltwater or coastal areas. As will be appreciated, the corrosion resistance of a protective layer can improve the durability and lifetime of such metal substrates. Examples of such metal substrates can include fasteners, aircraft engines, automotive parts, boats, and other marine components commonly found in, or near, saline environments. Examples of marine components can include light metal marine engine parts, outboards, and stern drives.

Additionally, a metal substrate can be a component of a heating, ventilating, and air conditioning ("HVAC") system. The protective coating in such systems can provide components with a longer lifetime and improved performance.

As can now be appreciated, the electrochemical deposition process can be useful for a variety of products and industries to provide a uniform, durable, and attractive surface to metal substrates.

Electrochemical deposition methods can provide a protective coating on a conductive metal substrate of an article in a batch process, a semi-batch process, or a continuous process. In certain embodiments, a batch process can be preferred to provide additional flexibility to the electrodeposition process. Generally, in a batch process, a conductive metal substrate of an article can be immersed in, or exposed to, an electrodeposition medium and voltage to receive a protective coating. However, many variations to such a batch process are possible. For example, a conductive metal substrate can be incrementally coated in certain batch processes by exposing only a small portion of the metal substrate to the electrodeposition medium, forming a protective coating on the small portion of the metal substrate, and then incrementally exposing more of the metal substrate to the electrodeposition medium. Such incremental batch coating processes can allow for reduced quantities of electrical current to be used or can allow for articles of irregular geometry to be coated. Incremental coating can also allow for smaller electrodeposition baths to be used. As can be further appreciated, other variations are also possible. For example, one or more portions of the conductive metal substrate can be protected from the electrodeposition medium with a water-proof coating, tape, or the like, to prevent electrodeposition of the protective coating in such covered portions. As can be appreciated, such steps can allow an article to have metal substrate portions unprotected by a protective coating. Such unprotected portions can be useful, for example, to allow for electrical connections or mechanical attachments to the article.

Alternatively, in certain embodiments, a metal substrate can be the surface of a wire (e.g., an electrically conductive wire) or a multi-stranded wire. For example, each individual strand of a stranded wire can be protected by an electrochemically deposited protective layer and then stranded together to form a finished stranded conductor. Alternatively, only certain strands, such as the outer-most strands in such a stranded conductor, can be coated with an electrochemically deposited protective coating. In such stranded conductors, the outer-most strands can be protected with an electrochemically deposited protective coating and then stranded together with bare strands to form a stranded conductor. This configuration provides stranded cables that offer the benefits of an electrochemically deposited protective coating but at a reduced cost.

In certain embodiments, an electrochemical deposition can also occur subsequent to the stranding of the conductors. In such embodiments, a previously stranded conductor can be immersed in, or exposed to, an electrochemical deposition medium and coated with an electrochemically deposited protective coating. As will be appreciated, such a method can provide a low-cost method of providing a protective coating to a multi-stranded conductor.

Electrochemical deposition methods can provide a protective coating on a conductive surface of a wire through a batch process, a semi-continuous batch process, a continuous process, or a combination of such processes. In a continuous process, a strand, or a multi-stranded conductor are continually advanced through an electrochemical deposition medium with voltage to receive a protective coating. In contrast, in a batch process or semi-continuous batch process, bare individual strands or a multi-stranded conductor are wound on a drum and then immersed in an electrochemical deposition medium to electrochemically deposit a protective coating.

In certain embodiments, a wire can be an overhead conductor. As can be appreciated, overhead conductors and cables can be formed in a variety of configurations including aluminum conductor steel reinforced ("ACSR") cables, aluminum conductor steel supported ("ACSS") cables, aluminum conductor composite core ("ACCC") cables and all aluminum alloy conductor ("AAAC") cables. ACSR cables are high-strength stranded conductors and include outer conductive strands, and supportive center strands. The outer conductive strands can be formed from high-purity aluminum alloys having a high conductivity and low weight. The center supportive strands can be steel and can have the strength required to support the more ductile outer conductive strands. ACSR cables can have an overall high tensile strength. ACSS cables are concentric-lay-stranded cables and include a central core of steel around which is stranded one, or more, layers of aluminum, or aluminum alloy, wires. ACCC cables, in contrast, are reinforced by a central core formed from one, or more, of carbon, glass fiber, or polymer materials. A composite core can offer a variety of advantages over an all-aluminum or steel-reinforced conventional cable as the composite core's combination of high tensile strength and low thermal sag enables longer spans. ACCC cables can enable new lines to be built with fewer supporting structures. AAAC cables are made with aluminum or aluminum alloy wires. AAAC cables can have a better corrosion resistance, due to the fact that they are largely, or completely, aluminum. ACSR, ACSS, ACCC, and AAAC cables can be used as overhead cables for overhead distribution and transmission lines.

FIGS. 1, 2, 3, and 4 illustrate various bare overhead conductors according to certain embodiments. Each overhead conductor depicted in FIGS. 1-4 can include the coating composition. Additionally, FIGS. 1 and 3 can, in certain embodiments, be formed as ACSR cables through selection of steel for the core and aluminum for the conductive wires. Likewise, FIGS. 2 and 4 can, in certain embodiments, be formed as AAAC cables through appropriate selection of aluminum or aluminum alloy for the conductive wires.

As depicted in FIG. 1, certain bare overhead conductors 100 can generally include a core 110 made of one or more wires, a plurality of round cross-sectional conductive wires 120 locating around core 110, and a protective layer 130. The protective layer 130 can be electrochemically deposited on conductive wires 120 or can be electrochemically deposited on only the exposed exterior portion of cable 100. The core 110 can be steel, invar steel, carbon fiber composite, or any other material that can provide strength to the conductor. The conductive wires 120 can be made of any suitable conductive material including copper, a copper alloy, aluminum, an aluminum alloy, including aluminum types 1350, 6000 series alloy aluminum, aluminum-zirconium alloy, or any other conductive metal.

Figure 2:
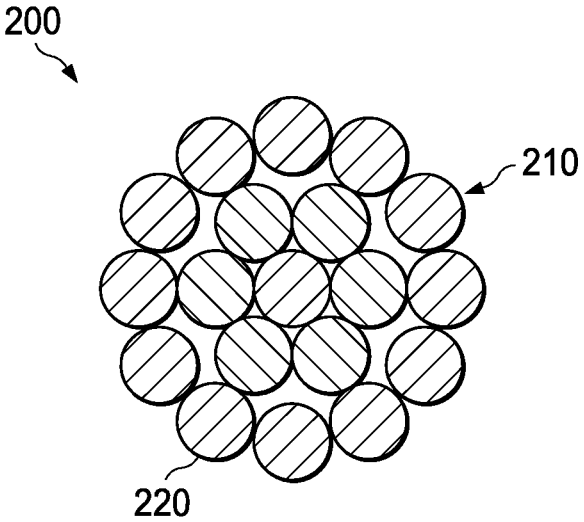
FIG. 2 depicts a cross-sectional view of a conductor in accordance with certain embodiments.

As depicted in FIG. 2, certain bare overhead conductors 200 can generally include round conductive wires 210 and a protective layer 220. The conductive wires 210 can be made from copper, a copper alloy, aluminum, an aluminum alloy, including aluminum types 1350, 6000 series alloy aluminum, an aluminum-zirconium alloy, or any other conductive metal. The protective layer 220 can be electrochemically deposited on conductive wires 210 or can be electrochemically deposited on only the exposed exterior portion of cable 200.

Figure 3:
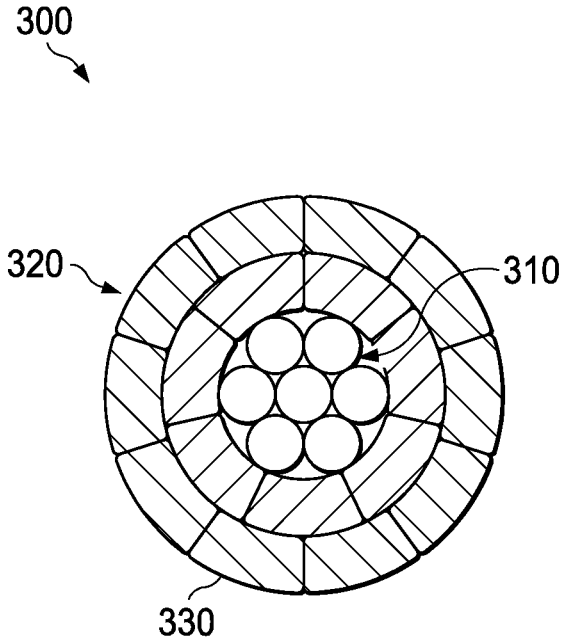
FIG. 3 depicts a cross-sectional view of a conductor in accordance with certain embodiments.

As seen in FIG. 3, certain bare overhead conductors 300 can generally include a core 310 of one or more wires, a plurality of trapezoidal-shaped conductive wires 320 around a core 310, and the protective layer 330. The protective layer 330 can be electrochemically deposited on conductive wires 320 or can be electrochemically deposited on only the exposed exterior portion of cable 300. The core 310 can be steel, invar steel, carbon fiber composite, or any other material providing strength to the conductor. The conductive wires 320 can be copper, a copper alloy, aluminum, an aluminum alloy, including aluminum types 1350, 6000 series alloy aluminum, an aluminum-zirconium alloy, or any other conductive metal.

Figure 4:
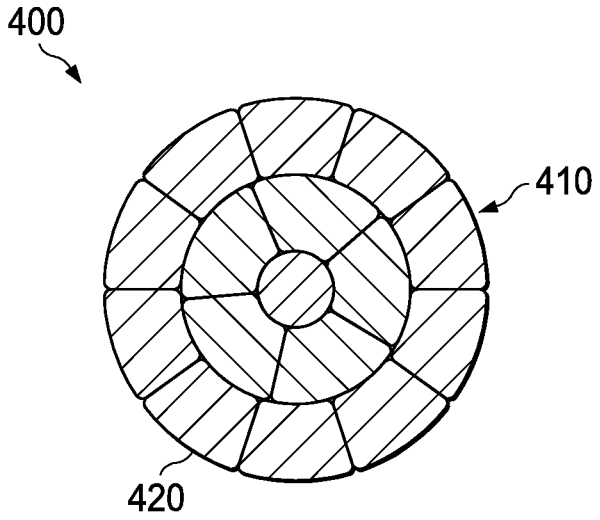
FIG. 4 depicts a cross-sectional view of a conductor in accordance with certain embodiments.

As depicted in FIG. 4, certain bare overhead conductors 400 can generally include trapezoidal-shaped conductive wires 410 and a protective layer 420. The conductive wires 410 can be formed from copper, a copper alloy, aluminum, an aluminum alloy, including aluminum types 1350, 6000 series alloy aluminum, an aluminum-zirconium alloy, or any other conductive metal. The protective layer 420 can be electrochemically deposited on conductive wires 410 or can be electrochemically deposited on only the exposed exterior portion of cable 400.

A protective coating can also, or alternatively, be utilized in composite core conductor designs. Composite core conductors are useful due to their lower sag at higher operating temperatures and their higher strength to weight ratio. A further reduction in conductor operating temperatures due to a protective coating can further lower the sag of certain composite core conductors and can lower the degradation of certain polymer resins in the composite. Non-limiting examples of composite cores can be found in U.S. Pat. Nos. 7,015,395; 7,438,971; 7,752,754, U.S. Patent App. No. 2012/0186851, U.S. Pat. Nos. 8,371,028; 7,683,262, and U.S. Patent App. No. 2012/0261158, each of which are incorporated herein by reference.

In certain embodiments, one or more of the wires in an overhead conductor can additionally be protected with a secondary coating in addition to the electrochemically deposited protective coating. Suitable examples of such secondary coatings can include polytetrafluoroethylene, fluoroethylene vinyl ether copolymer, paint, or a combination thereof. As can be appreciated, the secondary coating can be applied to individual wires in the overhead conductor or can be applied only to the exposed exterior portions of an overhead conductor.

A metal substrate can generally be formed from a variety of suitable metals including, for example, aluminum, copper, steel, zinc, magnesium, or any alloy thereof. In certain embodiments, the metal substrate can be galvanized. Non-limiting examples of metal substrates that can be galvanized include aluminum and steel metal substrates. In certain embodiments, the metal substrate can be formed of a different metal than the metal components in the electrodeposition medium. For example, if the metal substrate is formed from aluminum or an aluminum alloy, the protective coating can be silicon dioxide formed from an electrodeposition medium containing, for example, TEOS.

As will be appreciated, in certain embodiments, suitable metal substrates can also be formed on articles using techniques such as electroplating, galvanization, sol gel deposition, electroless depositions, and other know metal formation methods. Such techniques can be used independently, or in a multi-part process, to provide certain articles with metal substrates amenable to the application of an electrochemically deposited protective coating.

In one embodiment, conducting a current can electrochemically deposit a protective coating on a metal substrate through a plasma electrolytic deposition process. The metal substrate can effectively act as an anode in an electrochemical cell in conjunction with an electrodeposition medium and a provided cathode. The cathode can be formed of any suitable metal and can, in certain embodiments, match the metal ion of the metal components in the electrodeposition medium. Alternatively, in certain embodiments, a titanium cathode can be used. However, the electrochemical deposition medium is not limited to plasma electrolytic deposition and can, in certain embodiments, be used in electrochemical deposition processes that utilize voltages too low for plasma formation.

The current can be direct current, pulsed direct current, or alternating current. The current density can suitably vary from about 1 amp/ft$^2$ to about 30 amps/ft$^2$ in certain embodiments and can suitably vary from about 5 amps/ft$^2$ to about 15 amps/ft$^2$ in certain embodiments. The average voltage potential can vary from about 0.1 volt to about 600 volts. In certain embodiments, the average voltage potential can vary from about 0.1 volt to about 200 volts, about 5 volts to about 100 volts in certain embodiments, and about 10 volts to about 50 volts in certain embodiments. In other certain embodiments, such as, for example, plasma electrolytic deposition embodiments, the average voltage potential can vary from about 250 volts to about 600 volts, from about 350 volts to about 600 volts in certain embodiments, and from about 450 volts to about 550 volts in certain embodiments.

The current can be direct current or alternating current and can have any suitable waveform such as, for example, inverted sinewave, rectangular, triangular, and square waveforms. The frequency of such waveforms can vary from about 1 Hz to about 4,000 Hz. In certain embodiments, the current can be pulsed.

The current can be applied for a limited period of time during the electrochemical deposition process. For example current can be conducted for about 5 seconds to about 5 minutes in certain embodiments, for about 15 seconds to about 3 minutes in certain embodiments, and for about 30 seconds to about 1 minute in certain embodiments. As can be appreciated, such durations can be substantially shorter than the durations necessary for an anodization process.

As can be appreciated, an electrochemical deposition process can also include additional steps. For example, an electrochemical deposition process can include pretreating a metal substrate in order to clean and prepare the surface of the metal substrate before exposing the metal substrate to the electrodeposition medium. Suitable pretreatment steps can include hot water cleaning, ultrasonic cleaning, pressurized air cleaning, steam cleaning, brush cleaning, heat treatment, solvent wipe, plasma treatment, deglaring, desmutting, sandblasting, acidic or basic etching, passivation, and combinations thereof. Such processes can remove dirt, dust, oil, and oxidation or corrosion damage from the metal substrate before the electrochemical deposition process begins. Additionally, certain treatments, like passivation, can increase the weight and thickness of an electrochemically deposited protective coating layer. Such treatments permit additional flexibility in depositing a desired protective coating to a particular metal substrate to provide potential mechanical or electrical benefits to the final article.

Additionally, certain electrochemical deposition processes can also include drying the metal substrate subsequent to its contact with an electrodeposition medium. Drying can occur through a variety of methods such as through air drying or use of an oven depending on various circumstances including the size and configuration of the metal substrate. For example, when continuously electrochemically depositing a protective layer on a wire, it can be advantageous to dry the wire before the wire is rewound on a takeup spindle.

According to certain embodiments, an electrochemically deposited protective coating can have a number of desirable features including beneficial heat transfer properties, thickness, flexibility, corrosion resistance, and heat stability. As can be appreciated, such beneficial properties can improve various qualities of the underlying metal substrates the protective coating is deposited on. For example, an improved corrosion resistance can improve the lifespan of a wire conductor. Continuing, the protective coating can improve the current carrying capacity and ampacity of such wire by lowering the wire's operating temperature. As an additional example overhead conductors can have reduced ice and dust accumulation and improved corona resistance due to improved heat transfer, smoothness, and electrical insulation properties of the protective coating.

According to certain embodiments, an electrochemically deposited protective coating can have beneficial heat transfer properties that can help reduce the temperature of the metal substrate by dissipating heat faster than the untreated metal substrate alone. For example, in embodiments where the metal substrate is the surface of a wire, a conductor (e.g., electrically conductive wire) with an electrochemically deposited protective coating can operate about 5° C. or more cooler than a comparative conductor without the electrochemically deposited protective coating when both wires are operated under similar operating conditions (e.g., at an operating temperature measured at about 100° C. or higher).

Electrochemically deposited protective coatings can have a desirable thickness according to certain embodiments. For example, the electrochemically deposited protective coatings can have a thickness from about 1 micron to about 100 microns in certain embodiments, from about 5 microns to about 60 microns in certain embodiments, and from about 10 microns to about 35 microns in certain embodiments. The variability in thickness at different points of the metal substrate can be minimal. For example, in certain embodiments, the thickness of the electrochemically deposited protective layer can vary by about 3 microns or less, in certain embodiments by 2 microns or less, and in certain embodiments by about 1 micron or less.

In certain embodiments, articles having an electrochemically deposited protective coating can also demonstrate good flexibility and thermal stability. For example, articles can show no visible cracks when bent on a mandrel with a 0.5 inch diameter. In certain embodiments, the flexible coating can show no visible cracks when bent on mandrel diameters ranging from 0.5 inch to 5 inches. Additionally, articles can also exhibit good resistance to compressive forces. For example, an electrical connector having a protective coating as described herein can maintain integrity (e.g., the protective coating can remain adhered to the connector without cracking or abrading) following the stresses caused by crimping the connector.

Additionally, in certain embodiments, an article having an electrochemically deposited protective coating can remain stable after various water submersion tests including a water aging test, and a salt water aging test.

According to certain embodiments, metal substrates coated with electrochemically deposited protective coatings can pass the ASTM B 117 salt spray test which measures the susceptibility of a metal to corrosion. A coated aluminum sample strip 13 cm long, 1.2 cm wide, and 0.1 cm tall from Example 2 in Table 1 passed about 1,100 hours without corrosion or any change in weight, or appearance.

According to certain embodiments, articles having an electrochemically deposited protective coating can also remain stable after exposure to acidic pH or basic pH solutions.

An electrochemically deposited protective coating can be electrically conductive, semi-conductive or electrically insulating in certain embodiments. The conductance of the protective coating can vary depending on the quantity and thickness of each chemical species electrochemically deposited in the protective coating. As can be appreciated, metal oxides such as silicon dioxide are not electrically conductive and the quantity and thickness of such an oxide in the protective coating can influence electrical properties. It can therefore be appreciated that certain protective coatings, such as relatively thin protective coatings or coatings that incorporate certain additional fillers can be tailored for conductivity. As used herein, "electrically non-onductive" can mean a surface resistivity of about $10^4$ ohm or greater. An article having an electrochemically deposited protective coating can, in certain embodiments, have a surface resistivity ranging from about $10^5$ ohm to about $10^{12}$ ohm.

As can be appreciated, it can sometimes be desirable to remove a protective coating from a metal substrate. According to certain embodiments, a protective coating as described herein can be removed from a metal substrate through either mechanical forces or chemical means. For example, sufficient applied mechanical force can abrade the coating and eventually cause removal of the protective coating. As a specific example, a wire brush can be used to remove a protective coating from an electrical wire.

Alternatively, in certain embodiments, a solvent can be used to remove a protective coating as described herein. Generally, any suitable solvent that can dissolve the protective coating can be used to remove all, or a portion of, a protective coating. Although many commonly used solvents can be used, it can also be advantageous in certain embodiments to use solvents found in the electrodeposition mediums described herein. For example, in certain embodiments, quaternary ammonium compositions, such as choline, can be used to dissolve a protective coating.

Experimental

Test Methods

1. Temperature reduction: Thermal data for test samples was measured by applying a current through a wire sample coated with a protective coating deposited from inventive electrochemical deposition process and an uncoated comparative wire sample. The uncoated wire sample was selected from a similar aluminum or aluminum alloy substrate, but had no protective layer. Each sample wire had a diameter of about 0.1075 inch and a length of about 6.0 inches. Each sample was tested with the apparatus depicted in FIG. 5.

Figure 5:
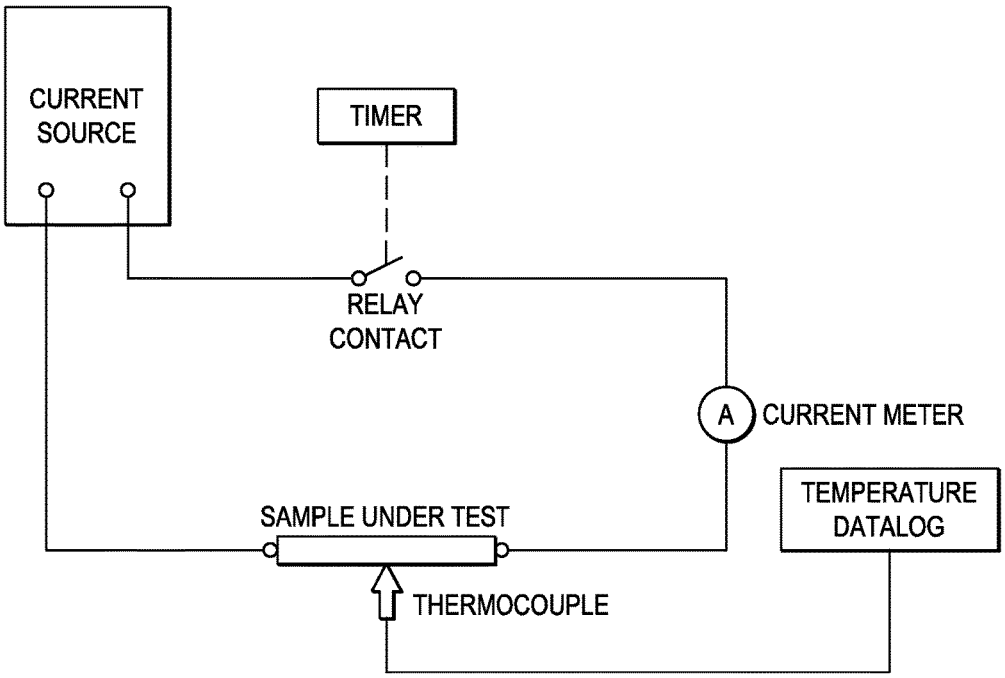
FIG. 5 depicts a schematic view of a test setup to evaluate reduction of the operating temperature of an electrically conductive wire formed with a protective coating.

As depicted in FIG. 5, the test apparatus includes a 60 Hz AC current source, a true RMS clamp-on current meter, a temperature datalog recording device, and a timer. Testing was conducted within a 68 inches wide×33 inches deep windowed safety enclosure to control air movement around the sample. An exhaust hood was located 64 inches above the test apparatus for ventilation.

The sample to be tested was connected in series with the AC current source through a relay contact controlled by the timer. The timer was used to control the time duration of the test. The 60 Hz AC current flowing through the sample was monitored by the true RMS clamp-on current meter. A thermocouple was used to measure the surface temperature of the sample. Using a spring clamp, the tip of the thermocouple was kept firmly in contact with the center surface of the sample. The thermocouple was monitored by the temperature datalog recording device to provide a continuous record of temperature.

Both uncoated and coated substrate samples were tested for temperature rise on this experimental set-up under identical conditions. The current was set at a desired level and was monitored during the test to ensure that a constant current was flowing through the samples. The timer was set at a desired value; and the temperature datalog recording device was set to record temperature at a recording interval of one reading per second.

For each test, the timer was activated concurrently with the current source to start the test. Once current was flowing through the sample, temperature immediately began rising. This surface temperature change was automatically recorded by the temperature datalog recording device. Once the testing period was completed, the timer automatically shut down the current source ending the test.

Once the uncoated sample was tested, it was removed from the set-up and replaced by the inventive sample with a protective coating. The inventive sample was tested in the same manner as the comparative uncoated sample.

The temperature test data was then accessed from the temperature datalog recording device and analyzed using a general purpose computer.

2. Flexibility Bend Test: The flexibility of the coating was tested both before and after heat aging using a Mandrel Bend test. In the Mandrel Bend Test, samples are bent on cylindrical mandrels of decreasing size and observed for any visible cracks in the coating at each of the mandrel sizes. The presence of visible cracks indicates failure of the sample. As can be appreciated, a decrease in the diameter of the mandrel increases the difficulty of the test. Samples were also heat aged to test the thermal stability of the protective coating. Samples were heat aged by placed the samples in an air circulation oven at a temperature of 250° C. for 7 days and then placed at room temperature for a period of 24 hrs. Samples are considered to have passed the Mandrel Bend Test if they do not have visible cracks when bent on mandrels having diameters as small as 0.5 inch both before and after heat aging. Wire samples having a diameter of 0.1075 inch and a length of 6.0 inches were used for the Mandrel Bend Test. While the Mandrel Bend Test is performed on a wire sample, the Mandrel Bend Test may be available for other metal substrates, or other flexibility bend tests can be developed or used in conjunction with other metal substrates.

3. Water aging: Samples were weighed on a balance and then water aged in water at 90° C. for 7 days. The samples were subsequently weighed again on a balance to determine the weight change. Wire samples having a diameter of 0.1075 inch and a length of 6.0 inches were used for water aging.

4. Salt solution aging: Samples were weighed on a balance and then submerged in a 3% sodium chloride aqueous solution for 7 days. The samples were subsequently weighed again on a balance to determine the weight change. Wire samples having a diameter of 0.1075 inch and a length of 6.0 inches were used for water aging.

5. Acidic or basic pH aging: Acidic pH solutions were prepared from dilution of concentrated sulfuric acid in water to form a solution with a pH of about 3 to about 4. Similarly, basic solutions were prepared from dilution of sodium hydroxide in water to form a solution with a pH of about 10 to about 11. Wire samples having a diameter of 0.1075 inch and a length of 6.0 inches were used for Acidic or Basic pH aging.

6. Salt Spray test: The Salt Spray test was conducted in accordance with ASTM B 117. In the ASTM B 117 test, a sharp blade is used to cut a cross mark through the protective coating to expose the bare metal surface. The sample is then sprayed with a salt bath spray in accordance with ASTM B 117 and then observed to note any corrosion at the cross mark, change in color or smoothness of the coating, or any weight change in the sample. Test samples were 13 cm long, 1.2 cm wide, and 0.1 cm tall.

Electrochemical deposited protective coatings deposited on metal substrates were evaluated using a standardized test procedure beginning with the preparation of an electrodeposition medium and the preparation of test samples. Each electrodeposition medium was prepared with the components disclosed in Table 1 using laboratory-grade reagents. Components were added sequentially to a 100 mL solution of demineralized water with each component added in a calculated stoichiometric quantity to the first added component. If multiple components were added, the metal component (e.g., primary metal or metalloid compound) was added last. Each electrodeposition medium was continually stirred until the metal component was completely dissolved. Additional demineralized water was then added to form a 1 liter solution for the electrodeposition medium.

Test samples were prepared using aluminum test strips or wire as noted in the Test Methods section. Test strips were formed from International Alloy Designation System aluminum alloy 1350. Each sample was surface treated by degreasing with acetone, etching in a solution of sodium or potassium hydroxide (50 g/L for 1 minute), rinsing in demineralized water, desmutting in 20% nitric acid for 1 minute, re-rinsing in demineralized water, and then wiped with a clean cloth to dry. To record weight gain, each test sample was weighed on a balance before the electrochemical deposition process.

Unless otherwise noted, test samples were electrochemically coated with a protective coating by submerging the test samples in an electrodeposition medium and connecting the test samples as an anode. Titanium cathodes were also submerged in the aqueous solution. Voltage between the two electrodes was raised steadily to about 400 volts and up to about 550 volts and maintained for about a minute. Plasma was observed during the electrochemical deposition process. After the electrochemical deposition process was completed, the test samples were removed, washed with demineralized water, and then dried and weighed.

TABLE 1

| Ex# | Electrodeposition medium | Weights (g/L of water) of components | Mole Ratio of components | Voltage (V) | Duration (min) | % Increasing in weight | Coating thickness (microns) |
|---|---|---|---|---|---|---|---|
| 1 | TEOS + Choline | 5.5:13 | 1:4 | 500 | 1 | <0.5 | 12.7 |
| 2 | Sodium Carbonate | 2 | NA | 530 | 1 | 1.25 | 35 |
| 3 | Sodium Carbonate + Phosphoric acid | 2:1.5 | 1:0.8 | 530 | 1 | 2.81 | 45.2 |
| 4 | AZC + Choline | 8.5:3.7 | 1:1.1 | 500 | 1 | 2.73 | 35 |
| 5 | AZC + Choline + Phosphoric acid | 8.5:3.7:1.5 | 1:1.1:0.5 | 500 | 1 | 1.23 | 13 |
| 6 | Sodium metasilicate | 4 | NA | 530 | 1 | — | 14 |

TABLE 1-continued

| Ex# | Electrodeposition medium | Weights (g/L of water) of components | Mole Ratio of components | Voltage (V) | Duration (min) | % Increasing in weight | Coating thickness (microns) |
|---|---|---|---|---|---|---|---|
| 7 | Molybdic acid + Choline | 1.6:2.4 | 1:2 | 500 | 1 | 0.07 | 11.5 |
| 8 | Molybdic acid + Choline + Phosphoric acid | 1.6:2.4:1.5 | 1:2:0.76 | 500 | 1 | 0.61 | 30.5 |
| 9 | Vanadium pentoxide + Choline | 1.8:4.8 | 1:4 | 500 | 1 | 0.37 | 19.1 |
| 10 | Aluminium iso-propoxide + Choline | 4:7.1 | 1:3 | 500 | 1 | — | — |

Table 1 depicts the chemistries of each of the electrodeposition mediums (excluding water) used to prepare test samples including the mole ratio and weights between each of the respective components. Table 1 also depicts the voltages used to electrochemically deposit a protective coating on each respective test samples, the duration of the electrochemical deposition process in coating the respective test samples. Table 1 further depicts the results of such electrochemical deposition methods and displays the weight gain and coating thickness associated with each electrodeposition chemistry.

TABLE 2

| Ex# | Operating Temperature Reduction (%) | Bend test (initial) | Bend test (Aged 7 day at 250° C.) | % Change in weight (after water aging at 90° C. for 7 days) | % Change in weight (after 3% salt aging 7 days) | % Change in weight (after aging in (3-4) pH for 7 days) | % Change in weight (after aging in (10-11) pH for 7 days) | Surface resistivity (ohm) |
|---|---|---|---|---|---|---|---|---|
| 1 | 22.1 | Pass | Pass | −0.03 | 0.01 | 0.00 | −0.12 | $10^8$ |
| 2 | 14.8 | Pass | Pass | 0.97 | 0.26 | 0.20 | 0.43 | $10^{10}$ |
| 3 | — | Pass | Pass | — | — | — | — | $10^{10}$ |
| 4 | 15.9 | Pass | Pass | 0.95 | 0.24 | 0.22 | 0.17 | $10^9$ |
| 5 | 15.9 | Pass | Pass | −0.08 | 0.04 | 0.02 | −0.07 | $10^9$ |
| 6 | 4.7 | Pass | Pass | 0.06 | 0.03 | −0.39 | −0.05 | $10^8$ |
| 7 | 7.7 | Pass | Pass | 0.04 | 0.02 | 0.00 | −0.09 | $10^9$ |
| 8 | — | Pass | Pass | — | — | — | — | $10^{10}$ |
| 9 | — | Pass | Pass | — | — | — | — | $10^8$ |
| 10 | — | Pass | Pass | — | — | — | — | $10^8$ |

Table 2 depicts the results of testing performed on the examples formed from the electrodeposition medium and methods described in Table 1. The operating temperature reduction, Mandrel Bend Test, water aging, and surface resistivity for each example sample are also reported in Table 2.

TABLE 3

| | Comparative Example 1 | Comparative Example 2 |
|---|---|---|
| Substrate | Aluminum 1350 | Aluminum 1350 |
| Coating | Sodium silicate + Zinc Oxide | Aluminum oxide |
| Application of Coating | Brushed | Anodized |
| Bend test (Initial) Mandrel Size | Cracks observed on a mandrel with a diameter of 4 inches | Cracks observed on a mandrel with a diameter of 8 inches |
| Bend test (Aged 7 day at 250° C.) Mandrel Size | Cracks observed on a mandrel with a diameter of 4 inches | Cracks observed on a mandrel with a diameter of 8 inches |

Table 3 depicts the results of the Mandrel Bend Test of Comparative Examples 1 to 2. The comparative examples include protective coatings applied by a brushing as well as anodization to 12.0 inches (L) by 0.50 inch (W) by 0.028 inch (T) aluminum 1350 grade samples. The thickness of the coating layer in Comparative Example 1 was about 8-10 microns and was about 20 microns in Comparative 2. The comparative examples failed the Mandrel Bend Test as the protective coatings cracked on the mandrels. In contrast, inventive examples 1 to 10 all passed the Mandrel Bend Test by not cracking on mandrels having a diameter as small as 0.5 inch.

Table 4 depicts the elemental composition of protective coatings formed of Example 1 (TEOS and choline) and Example 2 (sodium carbonate) described in Tables 1 and 2. The elemental composition of each example was determined by forming samples of the protective coating and examining the samples on a scanning electron microscope (TopCon SM 300 electron microscope using a tungsten filament providing 50×-100,000× magnification). After identifying the protective coating, an attached silicon drift energy-dispersive x-ray spectroscopy detector (IXRF Iridium Ultra) was used to measure the elemental composition.

TABLE 4

| Element | Example 1 | Example 2 |
|---|---|---|
| Silicon | 11.4% | 2.9% |
| Carbon | 18.4% | 14.8% |
| Oxygen | 18.3% | 20.5% |
| Fluorine | 0.0% | 3.1% |
| Sodium | 1.5% | 0.7% |
| Aluminum | 45.2% | 46.7% |
| Phosphorus | 2.6% | 8.3% |
| Chlorine | 0.2% | 0.1% |
| Potassium | 0.4% | 0.2% |
| Titanium | 1.8% | 2.7% |

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. An article comprising:

an electrically conductive metal substrate and a protective coating, the protective coating electrochemically deposited from an electrodeposition medium comprising:

a silicon alkoxide;

one or more quaternary ammonium compounds or quaternary phosphonium compounds, wherein the one or more quaternary ammonium compounds or quaternary phosphonium compounds are selected from the group consisting of tetra butyl ammonium hydroxide, benzyl triethyl ammonium hydroxide, tetra ethyl ammonium hydroxide, tetra methyl ammonium hydroxide, benzyl trimethyl ammonium hydroxide, trimethyl hydroxyethyl ammonium hydroxide, tetra butyl phosphonium hydroxide, benzyl triethyl phosphonium hydroxide, tetra ethyl phosphonium hydroxide, tetra methyl phosphonium hydroxide, benzyl trimethyl phosphonium hydroxide, and trimethyl hydroxyethyl phosphonium hydroxide; and water;

wherein the article is at least one of one or more electrically conductive wires in an overhead conductor.

2. The article of claim 1, wherein the silicon alkoxide comprises tetraethyl orthosilicate.

3. The article of claim 1, wherein the electrodeposition medium comprises a pH of about 8 to about 12.

4. The article of claim 1, wherein about 5% or more of the protective coating is electrochemically deposited onto the electrically conductive metal substrate from the electrodeposition medium.

5. The article of claim 1, wherein the protective coating comprises a thickness of about 5 microns to about 60 microns.

6. The article of claim 1, wherein about 99 weight percent or more of the protective coating remains after water aging at about 90 ° C. for about 7 days.

7. The article of claim 1, wherein the protective coating is semi-conductive or insulating and comprises a surface resistivity of about $10^6$ ohm or more.

8. The article of claim 1, wherein the protective coating is electrochemically deposited onto the metal substrate using a plasma electrolytic deposition process.

9. The article of claim 8, wherein the protective coating was electrochemically deposited on the electrically conductive metal substrate with current conducted at a voltage from about 400 volts to about 550 volts.

10. The article of claim 1, wherein the protective coating comprises silicon dioxide.

11. The article of claim 1 is an electrically conductive wire or an electrically conductive accessory selected from the group consisting of a connector, a clamp, and a busbar.

12. An article comprising:

an electrically conductive metal substrate and a protective coating, the protective coating electrochemically deposited from an electrodeposition medium comprising:

a silicon alkoxide;

one or more quaternary ammonium compounds or quaternary phosphonium compounds, wherein the one or more quaternary ammonium compounds or quaternary phosphonium compounds are selected from the group consisting of tetra butyl ammonium hydroxide, benzyl triethyl ammonium hydroxide, tetra ethyl ammonium hydroxide, tetra methyl ammonium hydroxide, benzyl trimethyl ammonium hydroxide, trimethyl hydroxyethyl ammonium hydroxide, tetra butyl phosphonium hydroxide, benzyl triethyl phosphonium hydroxide, tetra ethyl phosphonium hydroxide, tetra methyl phosphonium hydroxide, benzyl trimethyl phosphonium hydroxide, and trimethyl hydroxyethyl phosphonium hydroxide; and water;

wherein the mole ratio of the silicon alkoxide to the one or more quaternary ammonium compounds or quaternary phosphonium compounds ranges from about 1 to about 2 to a mole ratio of about 1 to about 7.

13. An article comprising:

an electrically conductive metal substrate and a protective coating, the protective coating electrochemically deposited from an electrodeposition medium comprising:

a silicon alkoxide;

one or more quaternary ammonium compounds or quaternary phosphonium compounds, wherein the one or more quaternary ammonium compounds or quaternary phosphonium compounds are selected from the group consisting of tetra butyl ammonium hydroxide, benzyl triethyl ammonium hydroxide, tetra ethyl ammonium hydroxide, tetra methyl ammonium hydroxide, benzyl trimethyl ammonium hydroxide, trimethyl hydroxyethyl ammonium hydroxide, tetra butyl phosphonium hydroxide, benzyl triethyl phosphonium hydroxide, tetra ethyl phosphonium hydroxide, tetra methyl phosphonium hydroxide, benzyl trimethyl phosphonium hydroxide, and trimethyl hydroxyethyl phosphonium hydroxide; and water;

wherein the article further comprises an operating temperature of about 5° C. or less than that of a comparative electrically conductive wire having the same electrically conductive metal substrate and no protective coating, when the operating temperature is measured at about 100° C. or greater.

* * * * *